US009543710B2

(12) United States Patent
Dunwoody et al.

(10) Patent No.: US 9,543,710 B2
(45) Date of Patent: Jan. 10, 2017

(54) CONNECTOR MODULE WITH CABLE EXIT REGION GASKET

(71) Applicant: Tyco Electronics Corporation, Berwyn, PA (US)

(72) Inventors: Steven David Dunwoody, Middletown, PA (US); Richard James Long, Columbia, PA (US); Alexander Michael Sharf, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 33 days.

(21) Appl. No.: 14/467,281

(22) Filed: Aug. 25, 2014

(65) Prior Publication Data

US 2016/0056585 A1 Feb. 25, 2016

(51) Int. Cl.

| | |
|---|---|
| ***H01R 9/03*** | (2006.01) |
| ***H01R 13/6592*** | (2011.01) |
| *H01R 12/53* | (2011.01) |
| *H01R 13/52* | (2006.01) |

(52) U.S. Cl.

CPC ..... *H01R 13/6592* (2013.01); *H01R 12/53* (2013.01); *H01R 13/5205* (2013.01)

(58) Field of Classification Search

CPC ..... H01R 13/658; H01R 9/032
USPC ..... 439/607.41, 607.47, 607.51, 607.56, 271
See application file for complete search history.

(56) References Cited

U.S. PATENT DOCUMENTS

| | | | | |
|---|---|---|---|---|
| 5,059,140 | A * | 10/1991 | Philippson | H01R 13/6593 439/607.02 |
| 5,538,440 | A * | 7/1996 | Rodrigues | H01R 9/032 439/404 |
| 5,562,497 | A * | 10/1996 | Yagi | H01R 13/516 439/607.47 |
| 5,848,914 | A * | 12/1998 | Lang | H01R 13/6592 439/607.47 |
| 6,305,961 | B1 * | 10/2001 | Szilagyi | H01R 13/6584 439/271 |
| 6,354,879 | B1 * | 3/2002 | Plehaty | H01R 9/032 439/607.41 |
| 6,971,905 | B2 * | 12/2005 | Makita | H02G 3/0691 439/447 |
| 7,083,472 | B2 * | 8/2006 | Gordon | H01R 13/6589 439/607.41 |
| 7,462,072 | B2 | 12/2008 | Anderson et al. | |
| 7,485,013 | B2 * | 2/2009 | Kuo | H01R 9/03 439/731 |

(Continued)

*Primary Examiner* — Abdullah Riyami
*Assistant Examiner* — Thang Nguyen

(57) ABSTRACT

A connector module includes a housing and a gasket. The housing is defined by a first shell and a second shell that mate at a seam. The housing includes a cable exit region extending along a cable axis. A passage through the cable exit region has an elliptical cross-section along a plane perpendicular to the cable axis. The gasket is within the passage of the cable exit region. An outer perimeter of the gasket in an uncompressed state has a non-elliptical cross section along a plane perpendicular to the cable axis. The gasket has an outer side engaging the inner surface of the cable exit region and an inner side configured to engage at least one cable received within the cable exit region. As the shells are mated, the gasket is sandwiched in a compressed state between the at least one cable and the cable exit region.

18 Claims, 6 Drawing Sheets

(56) References Cited

U.S. PATENT DOCUMENTS

| | | | | |
|---|---|---|---|---|
| 8,251,735 | B2 * | 8/2012 | Wu | H01R 13/5825 439/353 |
| 8,926,339 | B2 * | 1/2015 | Houtz | H01R 13/5045 439/76.1 |
| 8,979,555 | B2 * | 3/2015 | Lin | H01R 13/665 439/76.1 |
| 2004/0166742 | A1 * | 8/2004 | Chiu | H01R 13/5812 439/701 |
| 2009/0262968 | A1 * | 10/2009 | Akino | H01R 9/032 381/369 |
| 2010/0130063 | A1 * | 5/2010 | Lang | H01R 13/6593 439/607.17 |
| 2011/0086547 | A1 * | 4/2011 | Akino | H01R 9/032 439/607.41 |
| 2012/0015551 | A1 * | 1/2012 | Tobey | H01R 9/035 439/460 |
| 2014/0334110 | A1 * | 11/2014 | Nichols | H01R 31/08 361/729 |
| 2015/0044909 | A1 * | 2/2015 | Dunwoody | H01R 13/6593 439/607.56 |
| 2015/0229044 | A1 * | 8/2015 | Youtsey | H01R 9/0518 439/584 |

* cited by examiner

CONNECTOR MODULE WITH CABLE EXIT REGION GASKET

BACKGROUND OF THE INVENTION

The subject matter herein relates generally to electrical connector modules that include housings and cables extending therefrom.

In some electrical systems, an electrical connector, such as a plug or a receptacle, includes a cable extending from a housing. The housing holds electrical components, such as electrical contacts or a printed circuit board therein. The cable terminates to the electrical components within the housing. The housing of the electrical connector is configured to mate with a mating connector such that the electrical components within the housing electrically connect to electrical components of the mating connector. When mated to the mating connector, electrical power and/or data signals are transmitted between the electrical components of the mated connectors. The electrical connection between the mated connectors produces electromagnetic interference (EMI) within the housing. Electromagnetic interference is the disruption of operation of an electronic device due to an electromagnetic field caused by electromagnetic induction and/or radiation. The housing of the electrical connector may be configured to contain the EMI to prohibit the EMI from interfering with signal transmissions external to the housing, such as signals transmitted through the portion of the cable outside of the housing and/or other electronic devices in the surrounding environment. However, some known electrical systems fail to contain the EMI within the housing and electrical performance suffers as a result.

For example, EMI may leak through a cable opening in the housing through which the cable is received within the housing for electrical connection to the electrical components therein. The cable opening may be larger than the diameter of the cable such that the EMI leaks through gaps between the cable and the edge of the cable opening. In addition, some known housings are assembled by coupling two shells together, such that each shell defines at least part of the housing. The two shells couple together at a seam. If the two shells are not mated correctly, a gap may form at the seam, and EMI may leak through the gap out of the housing.

Some known systems use round gaskets that surround the cable at the cable opening for EMI containment. However, when assembling the electrical connector, a portion of the round gasket or a portion of the cable may get pinched in the seam between the two shells, thereby opening a gap in the seam that allows EMI to escape the housing. In addition, the cost of installing round gaskets around the cable may be prohibitive. A need remains for a connector module that provides better and more economical containment of EMI than prior art devices.

BRIEF DESCRIPTION OF THE INVENTION

In one embodiment, a connector module is provided that includes a housing and a gasket. The housing is defined by a first shell and a second shell that mate at a seam. An interior chamber within the housing is formed between the first and second shells. The housing includes a cable exit region extending along a cable axis. An inner surface of the cable exit region defines a passage from a cable opening to the interior chamber. The inner surface is curved such that the passage has an elliptical cross-section along a plane perpendicular to the cable axis. The gasket is within the passage of the cable exit region. The gasket extends along the cable axis between a front and a rear. An outer perimeter of the gasket in an uncompressed state has a non-elliptical cross-section along a plane perpendicular to the cable axis. The gasket has an outer side engaging the inner surface of the cable exit region and an inner side configured to engage at least one cable received within the cable exit region. As the first and second shells are mated, the gasket is sandwiched in a compressed state between the at least one cable and the cable exit region. The outer side of the gasket in the compressed state is configured to at least partially conform to the curved inner surface of the cable exit region to at least partially seal the passage between the at least one cable and the cable exit region.

In another embodiment, a connector module is provided that includes a housing and a gasket. The housing is defined by a lower shell and an upper shell that mate at a seam. An interior chamber within the housing is formed between the lower and upper shells. Each of the lower and upper shells includes a cable exit segment. Each cable exit segment has walls that engage the walls of the other cable exit segment at the seam to define a cable exit region that extends along a cable axis. Inner surfaces of the cable exit segments together define a passage through the cable exit region from the interior chamber to a cable opening. The inner surfaces are curved such that the passage has an elliptical cross-section along a plane perpendicular to the cable axis. The gasket is disposed in the cable exit segment of the lower shell. The gasket includes a conductive sleeve that, in an uncompressed state, extends along a gasket axis between a first end and a second end. The gasket axis is transverse to the cable axis. The conductive sleeve surrounds a compressive layer. The conductive sleeve along an outer side of the gasket engages the inner surface of the cable exit segment of the lower shell. The conductive sleeve along an inner side of the gasket is configured to engage at least one cable received between the cable exit segments of the upper and lower shells. The inner side of the gasket defines a crease in a creased state. The crease extends along the cable axis. The at least one cable is received over the crease. The gasket bends at the crease at least partially around the at least one cable as the lower and upper shells are mated.

In another embodiment, a connector module is provided that includes a housing and first and second gaskets. The housing is defined by a first shell and a second shell that mate at a seam. An interior chamber within the housing is formed between the first and second shells. Each of the first and second shells includes a cable exit segment. Each of the cable exit segments has walls that engage the walls of the other cable exit segment at the seam to define a cable exit region that extends along a cable axis. Inner surfaces of the cable exit segments together define a passage from the interior chamber to a cable opening. The inner surfaces are curved such that the passage has an elliptical cross-section along a plane perpendicular to the cable axis. The first gasket is disposed in the cable exit segment of the first shell. The second gasket is disposed in the cable exit segment of the second shell. Each of the first and second gaskets includes a conductive sleeve that, in an uncompressed state, extends along a gasket axis between a first end and a second end. The gasket axis is transverse to the cable axis. The first and second ends are disposed proximate to the walls of the corresponding cable exit segment. The conductive sleeve wraps around a compressive layer at a front and a rear of the respective gasket. The conductive sleeve along an outer side of each gasket engages the inner surface of the corresponding cable exit segment. The conductive sleeve along an inner side of each gasket is configured to engage a cable received between the cable exit segments. As the first and second shells are mated, the first gasket is sandwiched in a compressed state between the cable and the cable exit segment of the first shell, and the second gasket is sandwiched in a compressed state between the cable and the cable exit segment of the second shell. The first and second gaskets at least partially seal the passage between the cable and the cable exit segments.

DETAILED DESCRIPTION OF THE INVENTION

Figure 1:
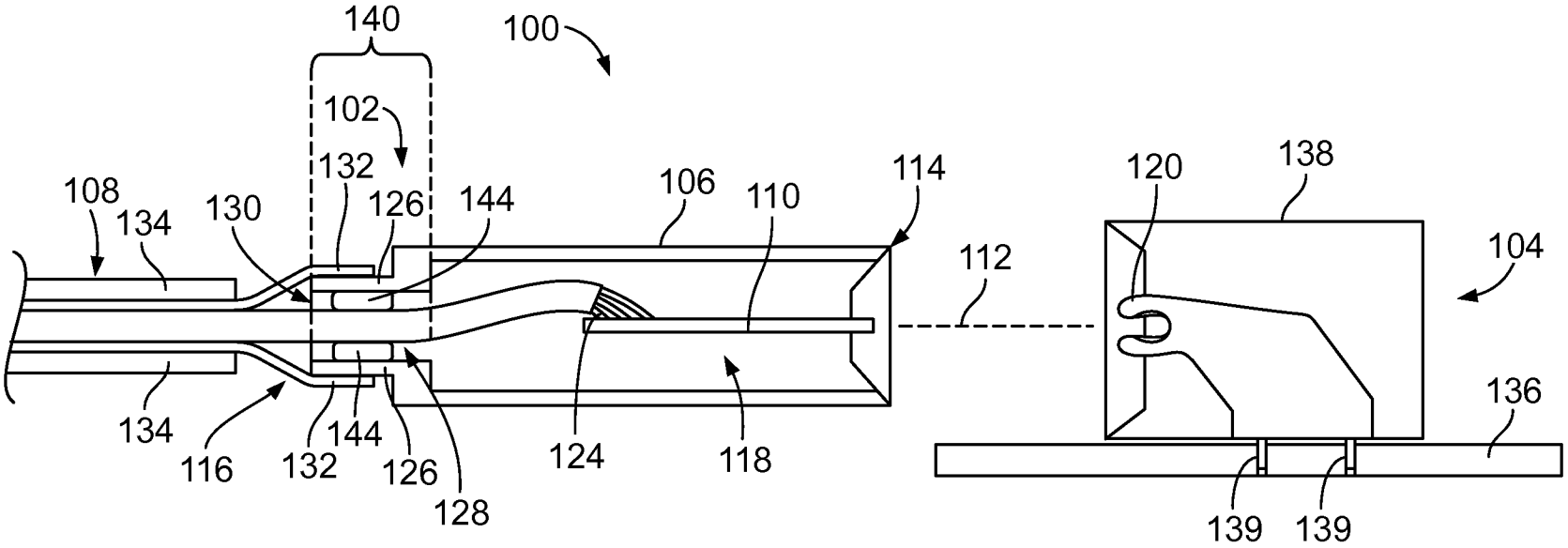
FIG. 1 is a side cross-sectional view of an electrical system in accordance with an embodiment.

FIG. 1 is a side cross-sectional view of an electrical system 100 in accordance with an embodiment. The electrical system 100 includes a connector module 102 and a mating connector 104. The connector module 102 is configured to mate with the mating connector 104 to form an electrical connection that provides a signal path for power and/or data signals through the connector module 102 and the mating connector 104. The connector module 102 may be a plug, and the mating connector 104 may be a receptacle that accommodates the plug. Alternatively, the connector module 102 is a receptacle, and the mating connector 104 is a plug.

The connector module 102 includes a housing 106, a cable 108, and an electrical component 110. The housing 106 extends between a mating end 114 and a cable end 116, which is opposite to the mating end 114. The mating end 114 interfaces with the mating connector 104, and the cable end 116 receives the cable 108. In other embodiments, more than one cable 108 may be received in the housing 106 through the cable end 116. In an alternative embodiment, the mating end 114 is not opposite to the cable end 116, such as if the housing 106 has a right angle shape instead of an in-line shape. The housing 106 defines an interior chamber 118. The electrical component 110 is held within the interior chamber 118. The electrical component 110 is configured to electrically connect to a mating electrical component 120 of the mating connector 104. The electrical component 110 in the illustrated embodiment is a circuit card or printed circuit board (PCB). In other embodiments, the electrical component 110 may be or include multiple conductive contacts. The cable 108 terminates to the electrical component 110 within the interior chamber 118. The cable 108 may include one or more exposed inner conductors 124 that electrically and mechanically engage vias or contact pads (not shown) of the electrical component 110. The cable 108 exits the housing 106 via a cable opening 130 at the cable end 116. The cable 108 extends from the housing 106.

In an embodiment, the housing 106 includes a cable exit region 126. The cable exit region 126 extends along a cable axis 112 and includes the cable end 116 of the housing 106. The cable exit region 126 defines a passage 128 for the cable 108 from the cable opening 130 to the interior chamber 118. A passage segment 140 of the cable 108 is positioned within the passage 128 of the housing 106. The cable exit region 126 provides a structure for coupling the cable 108 to the housing 106. For example, the cable 108 may include a braid 132 that is positioned along an exterior of the cable exit region 126. The braid 132 may be stretched from a non-expanded state within an outer jacket 134 of the cable 108 to an expanded state to position the braid 132 around the cable exit region 126. The braid 132 may be coupled to the cable exit region 126 by crimping a ferrule (not shown) onto the braid 132, by applying an adhesive, or the like, in order to mechanically and electrically connect the cable 108 to the housing 106.

The mating connector 104 includes a housing 138 that holds the mating electrical component 120 therein. The mating connector 104 may be a right angle connector, an in-line connector, a surface-mounted connector, a pass-through connector, or the like. In the illustrated embodiment, the mating electrical component 120 includes contacts arranged in an upper and a lower row. The contacts are configured to electrically and mechanically engage corresponding contact pads of the electrical component 110 (for example, the PCB) of the connector module 102. In other embodiments, the mating electrical component 120 may include other arrangements of contacts or a circuit card instead of contacts. The mating connector 104 in FIG. 1 is mounted on a printed circuit board 136. The mating electrical component 120 includes conductive pin contacts 139 that are through-hole mounted to the printed circuit board 136. In other embodiments, the mating connector 104 may be coupled to a cable or a device instead of being mounted to the printed circuit board 136.

The electrical connection formed between the connector module 102 and the mating connector 104 may generate electromagnetic interference (EMI). Electromagnetic interference may interfere with and degrade signal transmission along the signal path if the EMI is allowed to leak into and/or out of the housings 106, 138. For example, if EMI is not contained within the housings 106, 138, signal performance of the cable 108 and the PCB 136 may suffer, and signal performance of other devices coupled to or proximate to the cable 108 and/or the PCB 136 may suffer as well. In some known electrical systems, however, the housings fail to effectively contain the EMI, and the performance of the electrical systems suffers as a result.

Embodiments of the inventive subject matter described herein provide connector modules that restrict EMI leakage through the passage 128 at the cable end 116 of the housing 106, improving signal performance. For example, in embodiments described herein, one or more gaskets 144 may be wrapped or placed around the passage segment 140 of the cable 108 within the cable exit region 126 of the housing 106. The one or more gaskets 144 shown in the cross-sectional view of the electrical system 100 in FIG. 1 may be upper and lower portions of a single gasket 144 or may be distinct upper and lower gaskets 144. As described herein, the one or more gaskets 144 may be configured to seal the passage 128 between the cable 108 and the housing 106, to provide an electrical current path between the cable 108 and the housing 106, and to provide an unobstructed interface or seam between upper and lower shells of the housing 106 that mate at the interface to define the housing 106.

Figure 2:
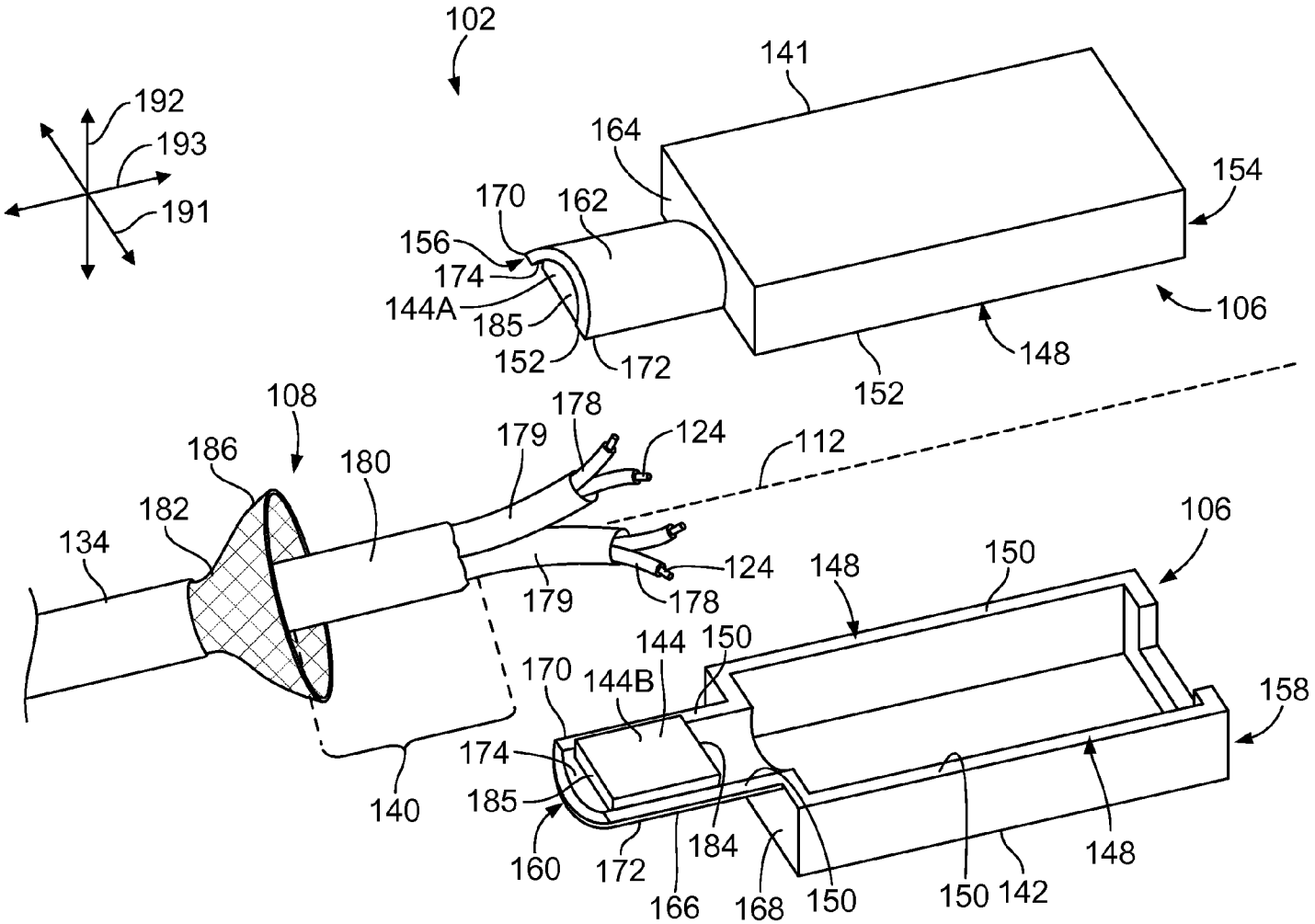
FIG. 2 is an exploded perspective view of a connector module of the electrical system according to an exemplary embodiment.

FIG. 2 is an exploded perspective view of the connector module 102 of the electrical system 100 shown in FIG. 1 according to an exemplary embodiment. The electrical component 110 (shown in FIG. 1) of the connector module 102 is not shown in FIG. 2. The connector module 102 is oriented with respect to a lateral axis 191, an elevation axis 192, and a longitudinal axis 193. The axes 191-193 are mutually perpendicular. Although the elevation axis 192 appears to extend in a vertical direction parallel to gravity in FIG. 2, it is understood that the axes 191-193 are not required to have any particular orientation with respect to gravity.

The housing 106 (shown assembled in FIG. 1) is defined by a first shell 141 and a second shell 142. The first and second shells 141, 142 mate at a seam 148 to form the assembled housing 106. The interior chamber 118 (shown in FIG. 1) is formed between the mated first and second shells 141, 142. In the illustrated embodiment, the first shell 141 is disposed over the second shell 142 along the elevation axis 192. As used herein, the first shell 141 may be referred to as "upper shell" 141, and the second shell 142 may be referred to as "lower shell" 142. Relative or spatial terms such as "upper," "lower," "top," "bottom," "left," or "right" are only used to distinguish the referenced elements and do not necessarily require particular positions or orientations in the electrical system 100 (shown in FIG. 1) or in the surrounding environment of the electrical system 100. The upper and lower shells 141, 142 may be mated by moving the shells 141, 142 relatively together along the elevation axis 192. The seam 148 may be formed between top walls 150 of the lower shell 142 and bottom walls 152 of the upper shell 141. The top walls 150 engage the bottom walls 152 at the seam 148 as the shells 141, 142 are mated. The upper and lower shells 141, 142 may be composed of one or more conductive materials, such as metal. In an embodiment, the shells 141, 142 are formed by a molding process, such as die-casting.

The upper shell 141 extends between a mating end 154 and a cable end 156. The upper shell 141 includes a cable exit segment 162 that extends from an intermediate wall 164 to the cable end 156. The cable exit segment 162 extends parallel to the cable axis 112 (which may be parallel to the longitudinal axis 193 shown in FIG. 2). The lower shell 142 also extends between a mating end 158 and a cable end 160. The lower shell 142 includes a cable exit segment 166 that extends from an intermediate wall 168 to the cable end 160. The cable exit segment 166 extends parallel to the cable axis 112. As the upper and lower shells 141, 142 are mated, the mating end 154 of the upper shell 141 aligns with the mating end 158 of the lower shell 142, and the cable end 156 aligns with the cable end 160. The cable exit segment 162 of the upper shell 141 aligns with the cable exit segment 166 of the lower shell 142 to define the cable exit region 126 (shown in FIG. 1) of the housing 106. In an alternative embodiment, the housing 106 may have a uni-body cable exit region 126 formed entirely by the upper shell 141 or the lower shell 142. In another alternative embodiment, the housing 106 has a uni-body structure and is not formed by the mating of two shells.

The cable exit segments 162, 166 each include a left edge 170 and a right edge 172 spaced apart laterally (along the lateral axis 191). The top walls 150 of the lower shell 142 may extend along the cable exit segment 166 at or proximate to each of the left and right edges 170, 172 of the lower shell 142. Likewise, the bottom walls 152 of the upper shell 141 may extend along the cable exit segment 162 at or proximate to each of the left and right edges 170, 172 of the upper shell 141. The top walls 150 of the cable exit segment 166 engage the bottom walls 152 of the cable exit segment 162 at the seam 148 to define the cable exit region 126 (shown in FIG. 1) of the housing 106. Each of the cable exit segments 162, 166 includes an inner surface 174 that extends between the left edge 170 and the right edge 172. For example, the inner surface 174 of the lower shell 142 may extend between the top wall 150 at or near the left edge 170 and the top wall 150 at or near the right edge 172. The inner surface 174 of the upper shell 141 may extend between the bottom wall 152 at or near the left edge 170 and the bottom wall 152 at or near the right edge 172. When the shells 141, 142 are assembled, the inner surfaces 174 of the cable exit segments 162, 166 combine to define the passage 128 (shown in FIG. 1) of the cable exit region 126 (FIG. 1).

In an embodiment, the inner surfaces 174 are arc-shaped. For example, each inner surface 174 may be concave relative to the edges 170, 172 of the respective cable exit segment 162 or 166, such that the inner surface 174 bows away from the edges 170, 172 as the inner surface 174 extends between the edges 170, 172. The inner surface 174 of each cable exit segment 162, 166 may bow away from the opposing cable exit segment 162 or 166, such that the passage 128 (shown in FIG. 1) defined between the cable exit segments 162, 166 has an elliptical cross-sectional shape. As used herein, the "elliptical" cross-sectional shape of the passage 128 means substantially elliptical and need not be a perfect ellipse such that the sum of the distances from two fixed points is a constant for every point along the curve. For example, the elliptical passage 128 may have one or more linear segments between curved segments. In an alternative embodiment, the inner surface 174 of at least one of the cable exit segments 162, 166 is not arc-shaped, but rather may include one or more linear walls, forming a V-shape, a box-shape, or the like.

The connector module 102 may include the cable 108 that extends from the housing 106. The cable 108 has at least one inner conductor 124, at least one insulation layer, at least one conductive shield layer, and the outer jacket 134. The insulation layer(s) surround the inner conductor(s) 124, the shield layer(s) surround the insulation layer(s), and the outer jacket 134 surrounds the shield layer(s). The at least one inner conductor 124 provides a signal path through the cable 108 for electrical signals. In the illustrated embodiment, the cable 108 includes four inner conductors 124. The inner conductors 124 may be composed of metal, such as copper, silver, or aluminum. Optionally, the inner conductors 124 may be organized into two sets of two conductors 124 and configured to convey differential signals. The inner conductors 124 are each individually surrounded by an insulation layer 178. The insulation layers 178 may be formed of a dielectric material, such as plastic, to provide electrical insulation and protection for the inner conductors 124. Optionally, the insulation layers 178 may be surrounded and enclosed within one of two intermediate layers 179 shown in FIG. 2. For example, each of the intermediate layers 179 may surround a separate differential pair of inner conductors 124. The intermediate layers 179 may include a conductive film and/or an insulating film, and may provide a ground reference for the differential pairs.

In an embodiment, the at least one conductive shield layer of the cable 108 includes an inner shield layer 180 and an outer shield layer 182 that surrounds the inner shield layer 180. The conductive shield layers 180, 182 provide electrical shielding of the signals traveling through the inner conductors 124. The inner shield layer 180 may be a foil layer formed of a metal foil. The outer shield layer 182 may be a cable braid similar to the braid 132 (shown in FIG. 1). As used herein, the inner shield layer 180 is referred to as foil layer 180, and the outer shield layer 182 is referred to as braid 182. The braid 182 may include metal strands woven or braided into a layer surrounding the foil layer 180. An end portion 186 of the braid 182 is recessed and stretched to an expanded state for positioning around the cable exit segments 162, 166 of the housing 106 to mechanically and electrically couple the cable 108 to the housing 106. The outer jacket 134 may be formed of a dielectric material, such as plastic or rubber, to provide electrical insulation, rigidity, and protection of the inner layers of the cable 108 from external forces.

In an embodiment, the passage segment 140 of the cable 108 is configured to be received within the passage 128 (shown in FIG. 1) of the housing 106, while the braid 182 and the outer jacket 134 are not received within the passage 128. As such, the outer perimeter of the passage segment 140 of the cable 108 is defined by the foil layer 180. In an alternative embodiment, the passage segment 140 of the cable 108 also includes the braid 182 alone or the braid 182 and the outer jacket 134, such that the braid 182 alone or the braid 182 and the outer jacket 134 are received within the passage 128 of the housing 106 between the cable exit segments 162, 166.

The one or more gaskets 144 are received in at least one of the cable exit segments 162, 166 prior to mating the upper and lower shells 141, 142. The one or more gaskets 144 extend along the cable axis 112 between a front 184 and a rear 185. The front 184 of each gasket 144 is disposed proximate to the respective intermediate wall 164, 168, and the rear 185 is disposed proximate to the respective cable end 156, 160. In the illustrated embodiment, the connector module 102 includes two gaskets 144. A first or upper gasket 144A is disposed in the cable exit segment 162 of the upper shell 141, and a second or lower gasket 144B is disposed in the cable exit segment 166 of the lower shell 142. The upper and lower gaskets 144A, 144B may be received in the respective cable exit segments 162, 166 prior to mating the upper and lower shells 141, 142.

In an embodiment, the connector module 102 is assembled by inserting the upper and lower gaskets 144A, 144B into respective cable exit segments 162, 166. Then, the cable 108 is placed on the gasket 144A of the upper shell 141 or the gasket 144B of the lower shell 142. Next, the two shells 141, 142 are moved relative to each other such that the shells 141, 142 engage each other at the seam 148, and the passage segment 140 of the cable 108 is entrapped within the passage 128 (shown in FIG. 1) between the cable exit segments 162, 166. The gaskets 144A, 144B each engage and at least partially surround the foil layer 180 of the passage segment 140. The gaskets 144A, 144B are each configured to at least partially seal the passage 128 between the cable 108 and the respective cable exit segments 162, 166 of the shells 141, 142.

Figure 3:
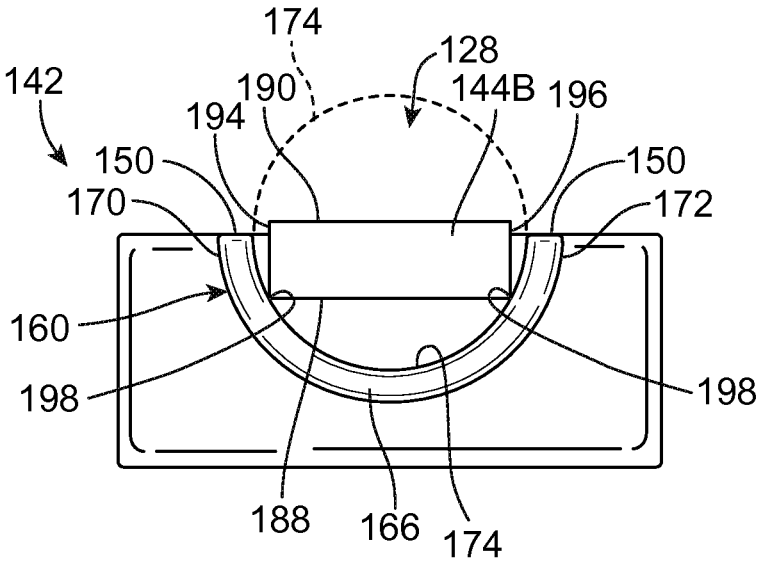
FIG. 3 is a rear view of a lower shell of the connector module according to an exemplary embodiment.

FIG. 3 is a rear view of the lower shell 142 of the connector module 102 (shown in FIGS. 1 and 2) according to an exemplary embodiment. The rear view shows the cable end 160 of the lower shell 142. The view is taken along a plane that is perpendicular to the cable axis 112 (shown in FIG. 2). The gasket 144B is disposed in the cable exit segment 166 of the lower shell 142. As described above, the inner surface 174 of the cable exit segment 166 is curved. The inner surface 174 of the cable exit segment 162 (shown in FIG. 2) of the upper shell 141 (FIG. 2) is shown in phantom in FIG. 3, and is also curved. As a result, the passage 128 defined between the inner surfaces 174 of the cable exit segments 162, 166 has an elliptical cross-section along the plane perpendicular to the cable axis 112. The inner surface 174 of each of the cable exit segments 162, 166 define half of the ellipse. As used herein, terms such as "ellipse," "elliptic," and "elliptical" refer to closed conic shapes that include ovals and circles. For example, the cross-section of the passage 128 shown in FIG. 3 may be generally circular.

In an exemplary embodiment, the outer perimeter of the gasket 144B has a non-elliptical cross section along the plane shown in FIG. 3 that is perpendicular to the cable axis 112 (shown in FIG. 2) when the gasket 144B is uncompressed, or in an "uncompressed state." For example, the gasket 144B in the illustrated embodiment has a generally rectangular cross-section along the plane. The gasket 144B extends between a first end 194 and a second end 196. The first end 194 may be proximate to the left edge 170 of the cable exit segment 166, and the second end 196 may be proximate to the right edge 172. The gasket 144B also has an outer side 188 and an inner side 190. The outer side 188 is configured to engage the inner surface 174 of the cable exit segment 166. The inner side 190 is configured to engage the cable 108 (shown in FIG. 2) received within the passage 128. As shown in FIG. 3, only edges 198 of the outer side 188 of the gasket 144B may engage the inner surface 174 when the gasket 144B is placed within the cable exit segment 166 prior to engaging the cable 108, since the gasket 144B is generally rectangular and not curved. The gasket 144B is referred to as "generally rectangular" because the opposite outer and inner sides 188, 190 may not be perfectly planar and/or perfectly parallel to each other. Likewise, the first and second ends 194, 196 of the gasket 144B also may not be perfectly planar and/or parallel. In other embodiments, the gasket 144B may have other non-circular cross-sections, such as triangular, V-shaped, or the like.

In an embodiment, the gasket 144 is stuffed into the cable exit segment 166 from above, from an axial direction, or from a combination of both. Upon being stuffed into the cable exit segment 166, the gasket 144B may bend along a crease in what is referred to herein as a "creased state." In the creased state, the gasket 144B does not have a generally rectangular cross-section. The interference between the gasket 144B and the inner surface 174 may hold the gasket 144B within the cable exit segment 166. Optionally, an adhesive (not shown) may be used to secure the gasket 144B to the inner surface 174. The adhesive may be a hot melt glue, a cold glue, or the like. The adhesive may be applied only to the edges 198 of the gasket 144B which engage the inner surface 174 prior to the cable 108 being received in the passage 128. Although the description in FIG. 3 focuses on the lower gasket 144B, the upper gasket 144A (shown in FIG. 2) optionally may include the same or similar features as the gasket 144B. For example, the upper gasket 144A may have a generally rectangular cross-section in the uncompressed state and be held within the cable exit segment 162 (shown in FIG. 2) in the creased state via an interference fit alone, or by the addition of an adhesive. In other embodiments, other retention means, such as tabs, latches, grooves, and the like may be used in addition to or instead of the adhesive to secure the gaskets 144A, 144B to the inner surfaces 174 of the corresponding cable exit segments 162, 166.

Figure 4:
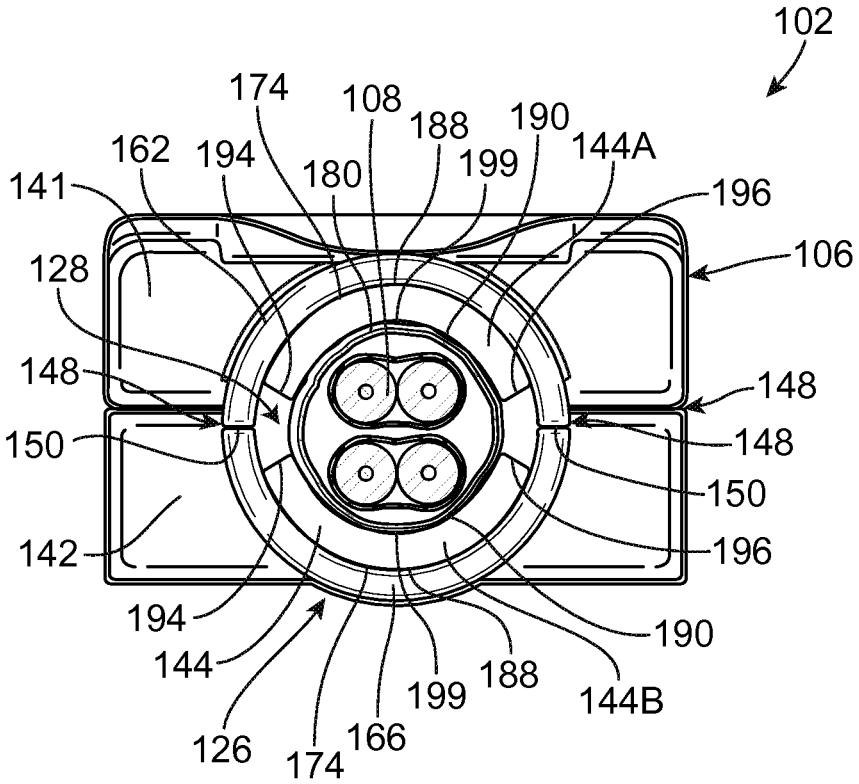
FIG. 4 is a rear view of the connector module according to an exemplary embodiment.

FIG. 4 is a rear view of the connector module 102 according to an exemplary embodiment. In the illustrated embodiment, the upper and lower shells 141, 142 are mated and engage each other at the seam 148. The cable 108 is received in the passage 128. The cable 108 is shown in cross-section for illustrative purposes to provide an unobstructed view of the cable exit region 126. The upper gasket 144A is sandwiched between the cable 108 and the cable exit segment 162 of the upper shell 141. Likewise, the lower gasket 144B is sandwiched between the cable 108 and the cable exit segment 166 of the lower shell 142. In an exemplary embodiment, the outer side 188 of each of the gaskets 144A, 144B is configured to at least partially conform to the curved inner surface 174 of the respective cable exit segment 162, 166. For example, compressive forces exerted upon the outer sides 188 of the gaskets 144A, 144B by the cable exit segments 162, 166, respectively, and the resistive forces exerted upon the inner sides 190 of the gaskets 144A, 144B by the cable 108 cause the gaskets 144A, 144B in a compressed state to conform to the space between the cable 108 and the cable exit segments 162, 166. Thus, although the gaskets 144 in one or more embodiments described herein may have a non-circular or even generally planar cross-section in the uncompressed state prior to assembling the connector module 102, the gaskets 144 may at least partially adopt a curved shape in the compressed state when the shells 141, 142 are mated. In conforming to the curved inner surfaces 174 of the cable exit segments 162, 166, the gaskets 144 may at least partially seal the passage 128 to prevent the transfer of EMI into and/or out of the interior region 118 (shown in FIG. 1).

In addition, the cable 108 may engage the inner sides 190 of the gaskets 144A, 144B at a middle region 199 along the length of the gaskets 144A, 144B between the first and second ends 194, 196 of each of the gaskets 144A, 144B. As the cable 108 compresses the middle regions 199 of the gaskets 144A, 144B, the first and second ends 194, 196 of the gaskets 144A, 144B may be pulled radially inwards towards the cable 108 and away from the seam 148 between the cable exit segments 162, 166. In addition, the ends 194, 196 of the upper gasket 144A may be pulled upwards away from the seam 148, and the ends 194, 196 of the lower gasket 144B may be pulled downwards away from the seam 148. For example, the first and second ends 194, 196 of the lower gasket 144B shown in FIG. 3 are more proximate to the top walls 150 of the cable exit segment 166 prior to assembly of the connector module 102 than the first and second ends 194, 196 shown in FIG. 4 after assembly. Thus, the first and second ends 194, 196 of the gaskets 144A, 144B are pulled away from the seam 148 as the upper and lower shells 141, 142 are mated, which prevents the ends 194, 196 of the gaskets 144A, 144B from getting pinched at the seam 148 and obstructing the engagement between the shells 141, 142.

The cable exit segments 162, 166 may be composed of a conductive material, such as one or more metals. In an embodiment, the gaskets 144 are composed of a compressive foam material that includes a conductive material embedded therein. For example, the conductive material may include metal particles or wires, such as aluminum, silver, or nickel. The conductive material allows the gaskets 144 to be electrically conductive. The conductive material may extend through the gaskets 144 between the inner side 190 and the outer side 188 of each gasket 144. When the connector module 102 is assembled, the inner side 190 engages the conductive foil layer 180 of the cable 108, and the outer side 188 engages the conductive inner surface 174 of the corresponding cable exit segment 162 or 166. The conductive material within the gaskets 144A, 144B provides an electrical current path between the cable 108 and the inner surface 174 of the cable exit region 126. The electrical current path electrically commons the foil layer 180 of the cable 108 with the cable exit region 126 of the housing 106.

Figure 5:
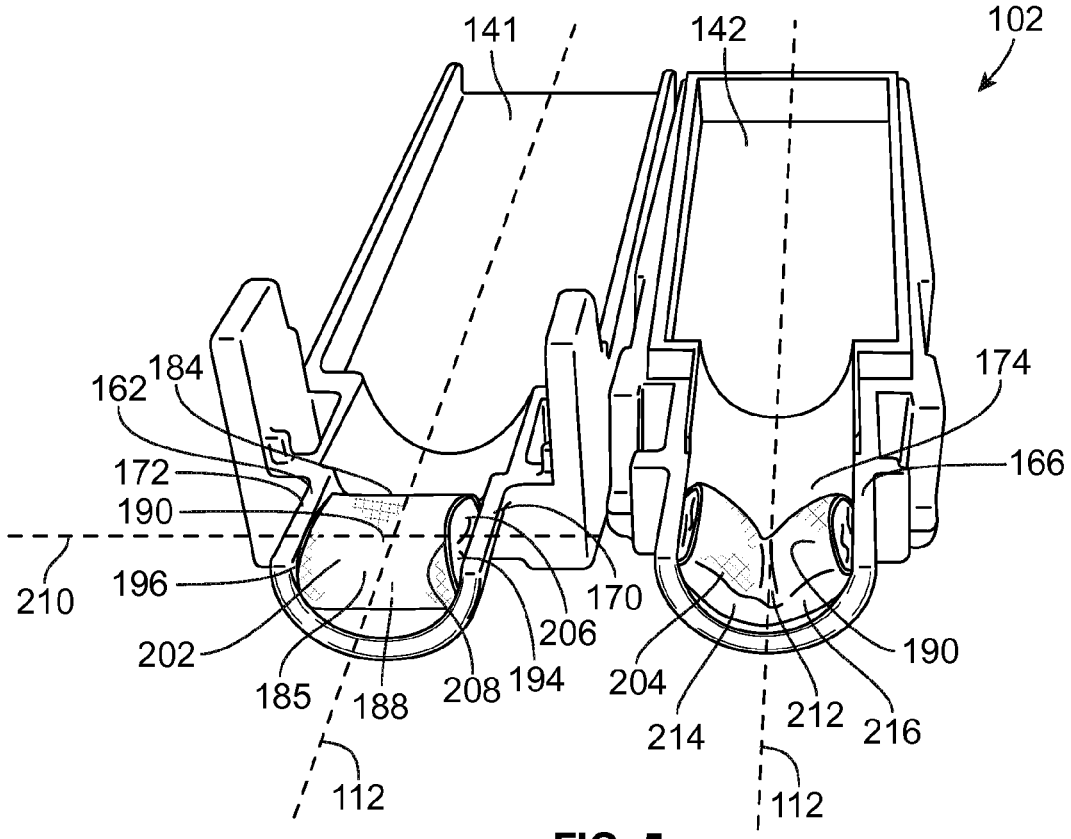
FIG. 5 is a perspective view of first and second shells of the connector module in an unmated position according to an exemplary embodiment.

FIG. 5 is a perspective view of the first and second shells 141, 142 of the connector module 102 (shown in FIG. 1) in an unmated position according to an exemplary embodiment. In the illustrated embodiment, the connector module 102 includes two gaskets—a first gasket 202 disposed in the cable exit segment 162 of the first or upper shell 141 and a second gasket 204 disposed in the cable exit segment 166 of the second or lower shell 142. The gasket 202 is shown in the uncompressed state, and the gasket 204 is shown stuffed into the cable exit segment 166 in the creased state. The gaskets 202, 204 may have the same or at least similar features, such that the following description of the first gasket 202 applies to the second gasket 204. The gasket 202 extends along a gasket axis 210 in the uncompressed state between the first and second ends 194, 196 of the gasket 202. The gasket axis 210 is transverse to the cable axis 112 along which the cable exit segment 162 is oriented. In other embodiments the gasket axis 210 may be oblique to the cable axis 112. Optionally, the gasket 202 may be oriented such that the gasket axis 210 is perpendicular to the cable axis 112. The gasket 202 includes a compressive layer 206 and a conductive layer 208. The compressive layer 206 is surrounded by the conductive layer 208. For example, the conductive layer 208 may have a tubular shape, such that the conductive layer 208 wraps around the compressive layer 206 at the front 184 and the rear 185 of the gasket 202. The conductive layer 208 extends between the first and second ends 194, 196 of the gasket 202, and may be referred to herein as a "conductive sleeve." Since the conductive layer 208 wraps around the compressive layer 206, both the inner side 190 and the outer side 188 of the gasket 202 may be defined by the conductive layer 208.

In an embodiment, the conductive layer 208 is a conductive fabric that is composed at least partially of woven metal strands. The compressive layer 206 may be a non-conductive foam material. As such, the conductive layer 208 may provide an electrical current path around a perimeter of the gasket 202, and the compressive layer 206 is configured to compress and provide a biasing force to retain mechanical contact between the gasket 202 and the cable 108 (shown in FIG. 1). Optionally, the first and second ends 194, 196 of the gasket 202 may be open, such that the compressive layer 206 is exposed. If the gasket 202 is oriented such that the gasket axis 210 is parallel to the cable axis 112, the open ends 194, 196 may provide an EMI leakage route through the compressive layer 206 of the gasket 202. However, in the illustrated embodiment, the gasket axis 210 of the gasket 202 is transverse to the cable axis 112. The conductive layer 208 extends at least mostly across the cable exit segment 162, blocking EMI leakage, and the open ends 194, 196 are disposed proximate to the left and right edges 170, 172. In other embodiments, the first and second ends 194, 196 may be closed, such as by sewing the inner side 190 of the conductive layer 208 to the outer side 188, to prevent EMI leakage through the compressive layer 206.

As shown in FIG. 5, the first gasket 202 is in the uncompressed state, such that the gasket 202 is not pressed into the curved cable exit segment 162. The first gasket 202 has a generally planar cross-section when viewed from the rear (similar to the gasket 144B shown in FIG. 3). The second gasket 204 is in the creased state, such that the gasket 204 is pressed or stuffed into the cable exit segment 166. The second gasket 204 does not have a planar cross-section when viewed from the rear. In an embodiment, both the first and second gaskets 202, 204 are stuffed into the corresponding cable exit segments 162, 166 prior to mating the first and second shells 141, 142. The gaskets 202, 204 each may transition from the uncompressed state to the creased state and then to the compressed state during the assembly of the connector module 102 (shown in FIG. 1).

The second gasket 204 in the creased state that is stuffed into the cable exit segment 166 includes a crease 212 on the inner side 190 of the gasket 204. The crease 212 is formed by pressing the planar gasket 204 into the curved cable exit segment 166. The crease 212 extends generally parallel to the cable axis 112. The cable axis 112 is shown with respect to both the first and second shells 141, 142 in FIG. 5 because the first and second shells 141, 142 are shown side-by-side. In an embodiment, each of the first and the second gaskets 202, 204 includes a crease 212 in the creased state upon being stuffed into the corresponding cable exit segments 162, 166. The crease 212 divides the gasket 204 into a left gasket segment 214 and a right gasket segment 216. The left and right gasket segments 214, 216 are angled relative to each other at the crease 212. For example, the angle between the gasket segments 214, 216 may be obtuse. The crease 212 allows the gasket 204 to at least partially conform to the curved inner surface 174 of the cable exit segment 166. Although not shown in FIG. 5, the gasket 204 may include a slit 234 (shown in FIG. 7) opposite the crease 212 to allow the gasket 204 to bend like a hinge along the crease 212.

Figure 6:
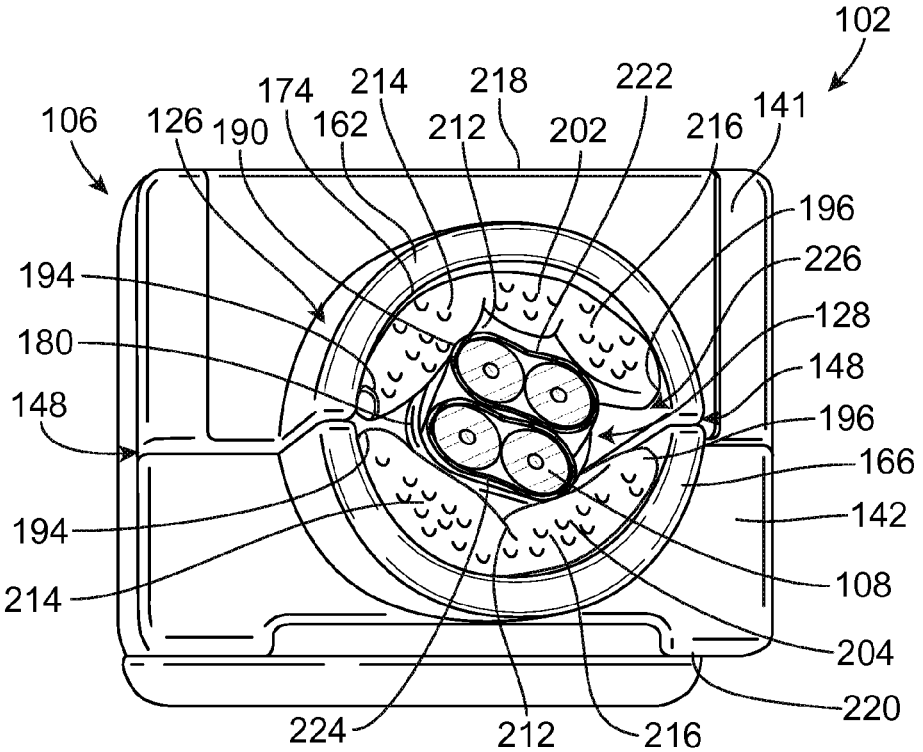
FIG. 6 is a rear view of the connector module according to an exemplary embodiment.

FIG. 6 is a rear view of the connector module 102 according to an exemplary embodiment. The cable 108 is disposed between the first and second gaskets 202, 204 in the cable exit region 126. In an embodiment, the cable 108 is received on the second gasket 204 within the cable exit segment 166 of the second or lower shell 142, and the first or upper shell 141 is subsequently lowered onto the lower shell 142 such that the inner side 190 of the first gasket 202 engages the cable 108. Alternatively, the cable 108 may first be received on the first gasket 202 within the cable exit segment 162 of the upper shell 141, or both shells 141, 142 may move relative to the cable 108 to surround the cable 108. In FIG. 6, both gaskets 202, 204 have a crease 212. The cable 108 is received over and/or partially within the creases 212 between the first and second gaskets 202, 204. As the shells 141, 142 are mated, the gaskets 202, 204 may bend and/or compress at the creases 212 in response to the resistive force applied by the cable 108 such that the left and right gasket segments 214, 216 at least partially surround the cable 108. In addition, the first and second ends 194, 196 of each of the gaskets 202, 204 may be pulled away from the seam 148, such as radially inwards toward the cable. The ends 194, 196 of the first gasket 202 in the cable exit segment 162 of the upper shell 141 may also be pulled upwards away from the seam 148 towards a top 218 of the connector module 102. Likewise, the ends 194, 196 of the second gasket 204 within the lower shell 142 may also be pulled downwards away from the seam 148 towards a bottom 220 of the connector module 102. Therefore, upon mating the shells 141, 142, the ends 194, 196 of the gaskets 202, 204 do not get pinched at the seam 148.

As shown in FIG. 6, the first gasket 202 is sandwiched between the cable 108 and the cable exit segment 162 of the upper shell 141, and the second gasket 204 is sandwiched between the cable 108 and the cable exit segment 166 of the lower shell 142. The first gasket 202 engages an upper portion 222 of an outer perimeter of the passage segment 140 (shown in FIGS. 1 and 2) of the cable 108, and the second gasket 204 engages a lower portion 224 of the outer perimeter. Each of the gaskets 202, 204 provides an electrical current path between the foil layer 180 of the cable 108 and the corresponding cable exit segment 162, 166 of the housing 106. The cable 108 is at least partially surrounded by the gaskets 202, 204. In an embodiment, the gaskets 202, 204 surround at least most of the outer perimeter of the cable 108. For example, although not shown in FIG. 6, the first end 194 of the first gasket 202 may engage the first end 194 of the second gasket 204 within the passage 128, and/or the second end 196 of the first gasket 202 may engage the second end 196 of the second gasket 204. As a result, the entire outer perimeter of the passage segment 140 of the cable 108 is surrounded by the gaskets 202, 204. Even if the ends 194, 196 of the gaskets 202, 204 do not engage each other and a gap 226 is formed proximate to the seam 148 on one or both sides, the gap 226 may be relatively small and allow a tolerable amount of EMI leakage. In addition to surrounding and engaging the cable 108, the gaskets 202, 204 together at least partially seal the passage 128 by filling the space that extends radially between the outer perimeter of the cable 108 and the inner surface 174 of the cable exit region 126.

Figure 7:
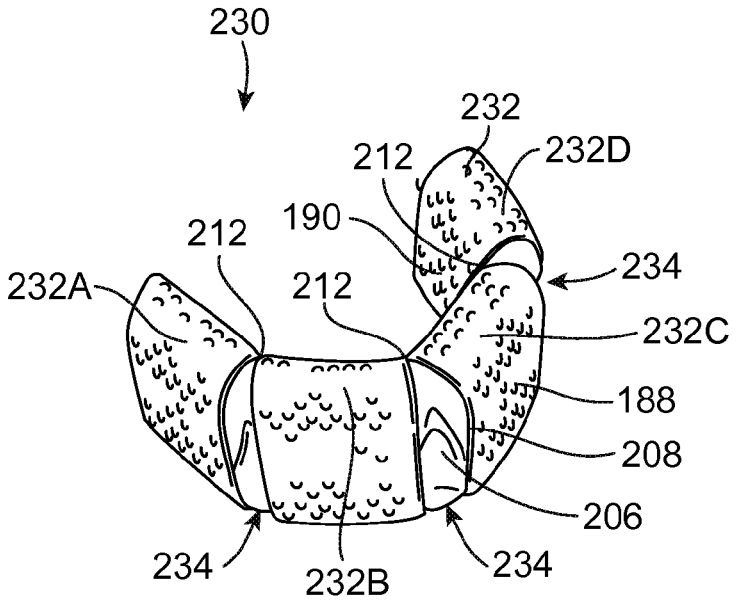
FIG. 7 is a perspective view of a gasket of the connector module according to an exemplary embodiment.

FIG. 7 is a perspective view of a gasket 230 of the connector module 102 (shown in FIG. 1) formed in accordance with an exemplary embodiment. The gasket 230 may be similar to the gaskets 202, 204 shown in FIGS. 5 and 6. For example, the gasket 230 includes a compressive layer 206 surrounded by a conductive layer 208. In addition, the gasket 230 may have a tubular shape that is generally planar in the uncompressed state prior to being bent and stuffed into one of the cable exit segments 162, 166 (shown in FIG. 6). The gasket 230 shown in FIG. 7 is at least partially bent to illustrate the features of the gasket 230. As compared to the gaskets 202, 204, the gasket 230 is longer, and includes plural creases 212 along the inner side 190. For example, the gasket 230 may be the length of both the first and second gaskets 202, 204 combined. The gasket 230 also includes multiple gasket segments 232 that are defined between the creases 212. In the illustrated embodiment, the gasket 230 has three creases 212 that define four gasket segments 232A, 232B, 232C, 232D. The creases 212 function as living hinges to allow the gasket segments 232 to rotate relative to adjacent gasket segments 232. The gasket 230 also includes plural slits 234. Each slit 234 is a cut on the outer side 188 of the gasket 230 opposite a corresponding one of the creases 212. Each slit 234 extends partially through the gasket 230 towards the crease 212. The slits 234 increase the ease of rotation as well as the magnitude of rotation of the gasket segments 232 along the creases 212. In other embodiments, the gasket 230 may be formed without the slits 234.

Figure 8:
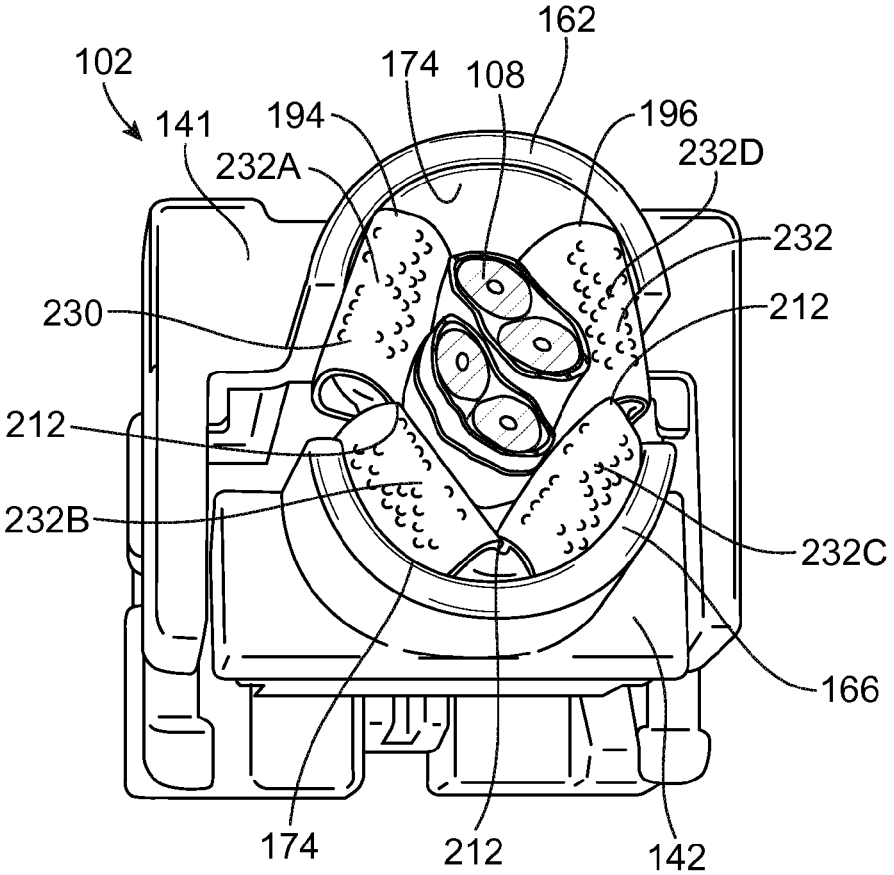
FIG. 8 is a rear view of the connector module in a partially-assembled state according to an exemplary embodiment.

FIG. 8 is a rear view of the connector module 102 in a partially-assembled state according to an exemplary embodiment. In FIG. 8, the upper shell 141 is being lowered onto the lower shell 142, or the lower shell 142 is being raised towards the upper shell 141. The middle two gasket segments 232B, 232C of the gasket 230 are received in the cable exit segment 166 of the lower shell 142. The cable 108 is disposed over the crease 212 between the middle two gasket segments 232B, 232C. The gasket 230 bends at the plural creases 212 to surround at least most of the outer perimeter of the cable 108. The plural gasket segments 232A-232D engage the outer perimeter of the cable 108 at different perimeter locations. In addition, the plural creases 212 and gasket segments 232 allow the gasket 230 to at least partially conform to the curved inner surfaces 174 of the cable exit segments 162, 166 of the respective shells 141, 142. In the illustrated embodiment, the outer two gasket segments 232A, 232D are received within the cable exit segment 162 of the upper shell 141. For example, the first and second ends 194, 196 of the gasket 230 are both received in the cable exit segment 162. In an embodiment, when the shells 141, 142 are fully mated, the first end 194 of the gasket 230 may engage the second end 196 of the gasket 230, such that the gasket 230 fully surrounds the outer perimeter of the cable 108.

Figure 9:
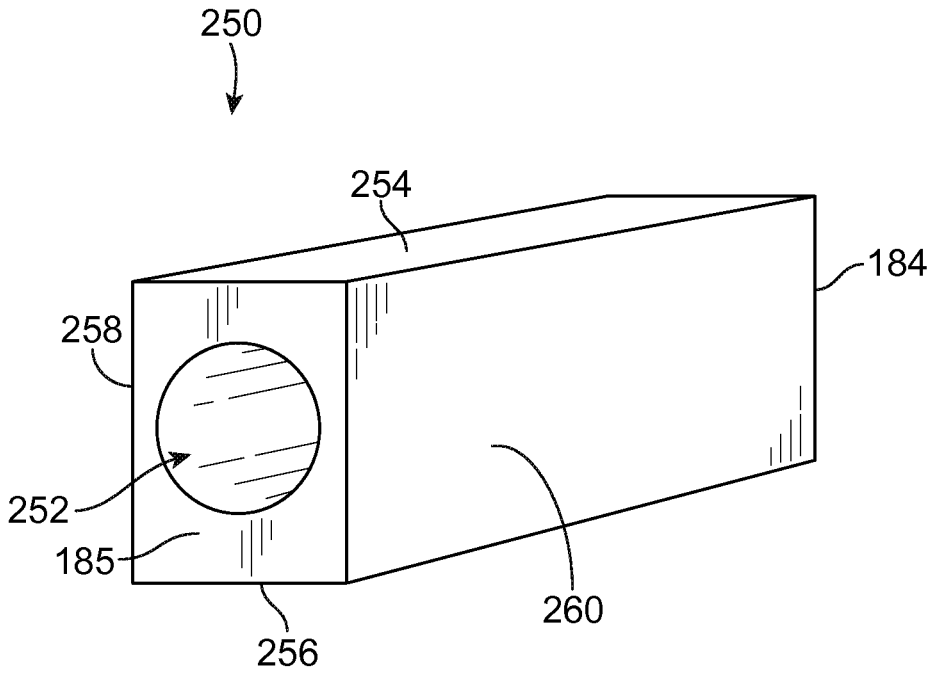
FIG. 9 is a perspective view of a gasket of the connector module according to an alternative embodiment.

FIG. 9 is a perspective view of a gasket 250 of the connector module 102 (shown in FIG. 1) according to an alternative embodiment. The gasket 250 is configured to be received within the passage 128 (shown in FIG. 1) of the cable exit region 126 (FIG. 1). The gasket 250 defines a channel 252 that extends through the gasket 250 from the front 184 of the gasket 250 to the rear 185. Within the passage 128, the channel 252 extends parallel to the cable axis 112 (shown in FIG. 1). The channel 252 is configured to receive the cable 108 (shown in FIG. 1) therein. The gasket 250 has a rectangular cross-sectional shape in the uncompressed state as shown. For example, a top side 254, bottom side 256, left side 258, and right side 260 of the gasket 250 are all planar surfaces. The gasket 250 may be at least partially formed of a compressive material. As the upper and lower shells 141, 142 (shown in FIG. 2) are mated, the cable exit segments 162, 166 (FIG. 2) force the top 254 and bottom 256 of the gasket 250 radially inwards to at least partially conform to the curved inner surfaces 174 (FIG. 2) of the cable exit segments 162, 166. Due to the compressive forces applied by the curved surfaces 174 on the gasket 250 in the compressed state, the left and right sides 258, 260 may bulge or project radially outward at least slightly. However, the left and right sides 258, 260 may be recessed from the seam 148 (shown in FIG. 2) on the corresponding sides of the cable exit region 126 in the uncompressed state prior to mating. The left and right sides 258, 260 are recessed a sufficient distance such that, even in the compressed state when the shells 141, 142 are fully mated, neither the bulging left side 258 nor the bulging right side 260 extends into the seam 148 to interfere with the mating of the shells 141, 142. The gasket 250, therefore, may at least partially seal the passage 128 around the cable 108 without obstructing the mating of the shells 141, 142. In an alternative embodiment, the gasket 250 may be split into an upper portion and a lower portion, such that the channel 252 is defined between the upper and lower portions. During assembly, the upper portion may be disposed in the cable exit segment 162, and the lower portion is disposed in the cable exit segment 166.

Figure 10:
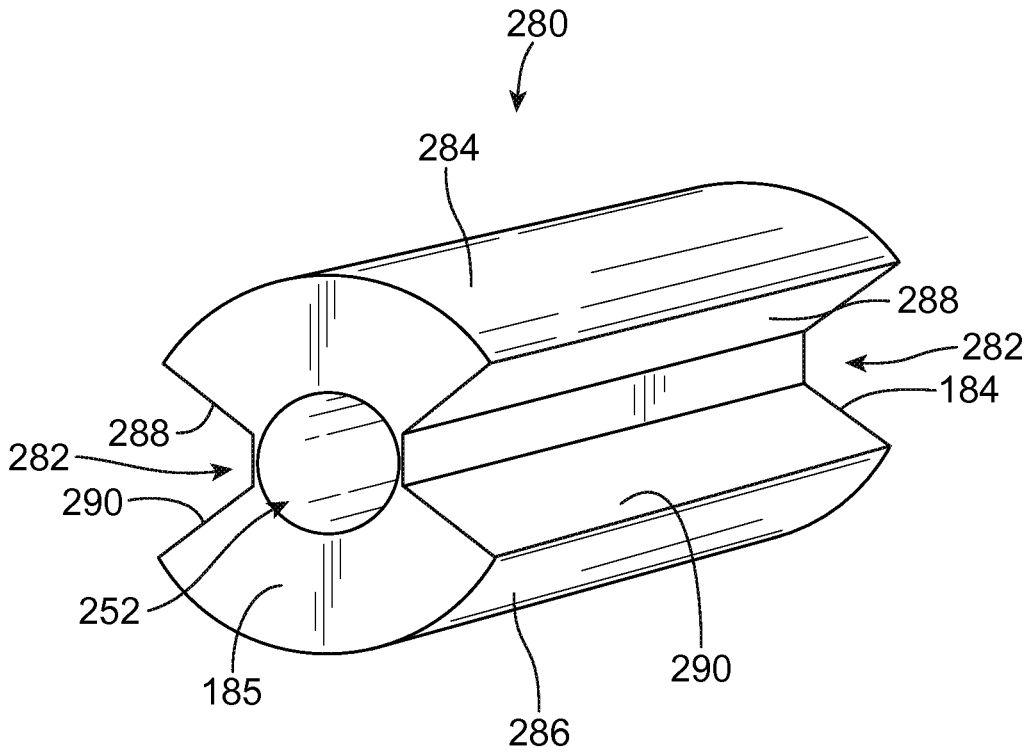
FIG. 10 is a perspective view of a gasket of the connector module according to another alternative embodiment.

FIG. 10 is a perspective view of a gasket 280 of the connector module 102 (shown in FIG. 1) according to another alternative embodiment. Like the gasket 250 (shown in FIG. 9), the gasket 280 includes a channel 252 between the front 184 and the rear 185 that is configured to receive the cable 108 (shown in FIG. 1). However, instead of having four planar sides that define a rectangular cross-section, the gasket 280 includes two side grooves 282 extending between the front 184 and the rear 185 to provide an hourglass cross-sectional shape in the uncompressed state. The gasket 280 has a top side 284 and a bottom side 286 defined between the side grooves 282. The top and bottom sides 284, 286 are curved in FIG. 10, although the top and bottom sides 284, 286 in other embodiments may be planar. Each side groove 282 is defined from above by an upper ledge 288 and from below by a lower ledge 290.

The gasket 280 is configured to be loaded into the cable exit region 126 (shown in FIG. 1) prior to mating the first and second shells 141, 142 (shown in FIG. 2). The side grooves 282 are aligned proximate to the seam 148 (shown in FIG. 2). In the uncompressed state of the gasket 280 shown in FIG. 10, the side grooves 282 each have an uncompressed height defined between the upper and lower ledges 288, 290. As the first and second shells 141, 142 are mated and the gasket 280 is compressed between the cable exit segments 162, 166 (shown in FIG. 2), the upper and lower ledges 288, 290 are forced to move relatively toward each other. When the gasket 280 is compressed in the compressed state, the side grooves 282 define a compressed height between the upper and lower ledges 288, 290 that is less than the uncompressed height of the side grooves 282. As the height of the side grooves 282 reduces, the gasket 280 seals more of the passage 128 (shown in FIG. 1) within the cable exit region 126. In addition, as the ledges 288, 290 move towards each other as the shells 141, 142 are mated, the ledges 288, 290 do not extend radially outward into the seam 148 to interfere with the mating of the shells 141, 142. The gasket 280, therefore, may at least partially seal the passage 128 around the cable 108 without obstructing the mating of the shells 141, 142. In an alternative embodiment, the gasket 280 may be split into an upper portion and a lower portion, such that the channel 252 is defined between the upper and lower portions. During assembly, the upper portion may be disposed in the cable exit segment 162, and the lower portion is disposed in the cable exit segment 166.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A connector module comprising: a housing defined by a first shell and a second shed that mate at a seam, and form an interior chamber therebetween, the housing including a cable exit region extending along a cable axis between the interior chamber and a cable opening of the housing, the cable exit region including a curved inner surface that defines a passage from the cable opening to the interior chamber, the passage having an elliptical cross-section along a plane perpendicular to the cable axis; and and a gasket within the passage of the cable exit region, the gasket including a conductive material such that the gasket is electrically conductive, the gasket extending along the cable axis between a front and a rear, an outer perimeter of the gasket in an uncompressed state having a non-elliptical cross-section along the plane perpendicular to the cable axis, the gasket having an outer side engaging the curved inner surface of the cable exit region and an inner side configured to engage at least one cable received within the cable exit region;

wherein the gasket has a compressive layer that is surrounded by a conductive layer, the conductive layer being composed of the conductive material of the gasket, the conductive layer having a tubular shape and extending between first and second ends, the conductive layer defining the inner side and the outer side of the gasket;

wherein, as the first and second shells are mated, the gasket is sandwiched in a compressed state between the at least one cable and the cable exit region, the outer side of the gasket in the compressed state configured to at least partially conform to the curved inner surface of the cable exit region to at least partially seal the passage between the at least one cable and the cable exit region.

2. The connector module of claim 1, wherein the gasket has a rectangular cross-section in the uncompressed state along the plane perpendicular to the cable axis.

3. The connector module of claim 1, wherein the gasket includes a crease on the inner side of the gasket in a creased state of the gasket, the crease extending along the cable axis between the front and rear of the gasket, the at least one cable being received over the crease, the gasket bending at the crease as the first and second shells are mated.

4. The connector module of claim 3, wherein the outer side of the gasket includes a slit opposite the crease, the slit extending radially partially through the gasket.

5. The connector module of claim 1, wherein the gasket in the uncompressed state extends along a gasket axis between the first and second ends, the gasket axis being transverse to the cable axis.

6. The connector module of claim 1, the compressive layer is a non-conductive foam and the conductive layer is composed of a conductive fabric.

7. The connector module of claim 1, wherein the gasket defines a channel extending through the gasket From the front to the rear along the cable axis, the channel configured to receive the at least one cable therein.

8. The connector module of claim 7, wherein the gasket includes at least one side groove that extends between the front and rear, the side groove aligned proximate to the seam of the housing, each side groove having an uncompressed height defined by an upper ledge and a lower ledge, wherein, as the First and second shells are mated, the upper and lower ledges are moved relatively towards each other such that the side groove has a compressed height that is less than the uncompressed height.

9. The connector module of claim 1, wherein the inner and outer sides of the gasket extend laterally between first and second ends of the gasket, the outer side of the gasket in the uncompressed state engaging the curved inner surface of the cable exit region at edges of the gasket proximate to the first and second ends such that a space is defined between the outer side of the gasket and the curved inner surface of the cable exit region laterally between the edges of the gasket, wherein, in the compressed state, the outer side or the gasket conforms to the curved inner surface such that a volume of the space between the outer side and the curved inner surface is reduced relative to the volume of the space in the uncompressed state.

10. A connector module comprising: a housing defined by a lower shell and an upper shell that mate at a seam, an interior chamber within the housing is formed between the lower and upper shells, each of the lower and upper shells including a cable exit segment, each cable exit segment having walls that engage the walls of the other cable exit segment at the seam to define a cable exit region that extends along a cable axis, inner surfaces of the cable exit segments together defining a passage through the cable exit region from the interior chamber to a cable opening, the inner surfaces being curved such that the passage has an elliptical cross-section along a plane perpendicular to the cable axis;

and a gasket disposed in the cable exit segment of the lower shell, the gasket including a conductive sleeve that, in an uncompressed state, extends along a gasket axis between a first end and a second end, the gasket axis being transverse to the cable axis, the conductive sleeve surrounding a compressive layer, the conductive sleeve along an outer side of the gasket engaging the inner surface of the cable exit segment of the lower shell, the conductive sleeve along an inner side of the gasket configured to engage at least one cable received between the cable exit segments of the upper and lower shells, the inner side of the gasket defining a crease in a creased state, the crease extending along the cable axis, the at least one cable being received over the crease, the gasket bending at the crease at least partially around the at least one cable as the lower and upper shells are mated.

11. The connector module of claim 10, wherein the walls of the cable exit segment of the lower shell are left and right walls, the first and second ends of the gasket being disposed proximate to the corresponding left and right walls of the lower shell, wherein, as the lower and upper shells are mated, the gasket bends at the crease and the first and second ends are forced radially inward towards the at least one cable and away from the first and second walls.

12. The connector module of claim 10, wherein the first and second ends of the gasket are received within the cable exit segment of the upper shell as the lower and upper shells are mated, the first and second ends engaging each other such that the gasket surrounds an outer perimeter of the at least one cable within the cable exit region.

13. The connector module of claim 10, wherein the crease is one of plural creases on the inner side of the gasket; the gasket further including plural slits on the outer side of the gasket, each slit opposite a corresponding crease, each slit extending partially through the gasket, wherein the gasket includes multiple gasket segments defined between the slits, the gasket in a compressed state configured to bend at the creases to at least partially conform to the curved inner surfaces of the lower and upper shells and to surround at least most of an outer perimeter of the at least one cable, the gasket segments engaging the at least one cable at different locations along the outer perimeter.

14. A connector module comprising: a housing defined by a first shell and a second shell that mate at a seam, an interior chamber within the housing being formed between the first and second shells, each of the first and second shells including a cable exit segment, each of the cable exit segments having was that engage the walls of the other cable exit segment at the seam to define a cable exit region that extends along a cable axis, inner surfaces or the cable exit segments together defining a passage from the interior chamber to a cable opening, the inner surfaces being curved such that the passage has an elliptical cross-section along a plane perpendicular to the cable axis; and first and second gaskets, the first gasket disposed in the cable exit segment of the first shell, the second gasket disposed in the cable exit segment of the second shell, each of the first and second gaskets including a conductive sleeve that, in an uncompressed state, extends along a gasket axis between a first end and a second end, the gasket axis being transverse to the cable axis, the first and second ends disposed proximate to the was of the corresponding cable exit segment, the conductive sleeve wrapping around a compressive layer at a front and a rear of the respective gasket, the conductive sleeve along an outer side of each gasket engaging the inner surface of the corresponding cable exit segment, the conductive sleeve along an inner side of each gasket configured to engage a cable received between the cable exit segments; wherein, as the first and second shells are mated, the first gasket is sandwiched in a compressed state between the cable and the cable exit segment of the first she and the second gasket is sandwiched in a compressed state between the cable and the cable exit segment of the second shell, the first and second gaskets at least partially sealing the passage between the cable and the cable exit segments.

15. The connector module of claim 14, wherein the inner surfaces of the cable exit segments are formed of a conductive material, the conductive sleeve along the inner side of each of the first and second gaskets engaging a conductive shield layer of the cable, the conductive sleeves of the First and second gaskets providing an electrical current path between the conductive shield layer of the cable and the conductive inner surfaces of the corresponding cable exit segments.

16. The connector module of claim 14, wherein the first shell is an upper shell and the second she is a lower shell, and, as the upper and lower shells are mated, the first gasket disposed in the cable exit segment of the upper shell engages an upper portion of an outer perimeter of the cable and the second gasket disposed in the cable exit segment of the lower shell engages a lower portion of the outer perimeter of the cable.

17. The connector module of claim 14, wherein the first and second gaskets in a creased state each define a crease on the inner side of the respective gasket, each crease extending along the cable axis and dividing the corresponding gasket into left and right gasket segments, the cable being received over the crease of each gasket, each of the gaskets configured to bend at the respective crease at least partially around the cable such that an angle between the left and right gasket segments of each gasket is obtuse.

18. The connector module of claim 14, wherein the first end of the first gasket engages the first end of the second gasket and the second end of the first gasket engages the second end of the second gasket as the first and second shells are mated such that the combination of the first and second gaskets surrounds an outer perimeter of the cable within the cable exit region.

* * * * *